US007246664B2

(12) United States Patent
Shammai et al.

(10) Patent No.: US 7,246,664 B2
(45) Date of Patent: Jul. 24, 2007

(54) DUAL PISTON, SINGLE PHASE SAMPLING MECHANISM AND PROCEDURE

(75) Inventors: Houman M. Shammai, Houston, TX (US); John M. Michaels, Cypress, TX (US); James T. Cernooek, Missouri City, TX (US); Michael J. Moody, Katy, TX (US); Phillip Wills, Aberdeenshire (GB)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/242,112

(22) Filed: Sep. 12, 2002

(65) Prior Publication Data

US 2003/0066646 A1 Apr. 10, 2003

Related U.S. Application Data

(60) Provisional application No. 60/323,220, filed on Sep. 19, 2001.

(51) Int. Cl.
*E21B 49/08* (2006.01)

(52) U.S. Cl. ..... 166/264; 166/100

(58) Field of Classification Search ..... 166/264, 166/100; 125/20, 40, 58, 59
See application file for complete search history.

(56) References Cited

U.S. PATENT DOCUMENTS

| | | | | |
|---|---|---|---|---|
| 3,859,850 | A | 1/1975 | Whitten et al. | |
| 4,766,955 | A | 8/1988 | Petermann | |
| 4,936,139 | A | 6/1990 | Zimmerman et al. | |
| 4,940,088 | A | 7/1990 | Goldschild | |
| 5,009,100 | A | 4/1991 | Gruber et al. | |
| 5,058,674 | A * | 10/1991 | Schultz et al. | 166/264 |
| 5,337,822 | A | 8/1994 | Massie et al. | |
| 5,361,839 | A | 11/1994 | Griffith et al. | |
| 5,377,755 | A * | 1/1995 | Michaels et al. | 166/264 |
| 5,549,162 | A | 8/1996 | Moody et al. | |
| 5,662,166 | A | 9/1997 | Shammai | |
| 6,182,753 | B1 | 2/2001 | Schultz | |
| 6,467,544 | B1 * | 10/2002 | Brown et al. | 166/264 |
| 6,702,017 | B1 | 3/2004 | Corrigan et al. | |
| 2002/0060067 | A1 * | 5/2002 | Bolze et al. | 166/264 |

FOREIGN PATENT DOCUMENTS

| | | |
|---|---|---|
| CA | 2147027 | 10/1995 |
| CA | 2299835 | 9/2000 |
| EP | 0 092 975 | 11/1983 |
| GB | 2012722 A | 8/1979 |

(Continued)

*Primary Examiner*—William P. Neuder
(74) *Attorney, Agent, or Firm*—Madan, Mossman & Sriram, P.C.

(57) ABSTRACT

A method and apparatus for maintaining the single phase integrity of a deep well formation sample that is removed to the surface comprises a vacuum jacket insulated single working cylinder divided by two free pistons into three variable volume chambers. The intermediate chamber is pre-charged with a fixed quantity of high pressure gas. Wellbore fluid freely admitted to one end chamber bears against one free piston to further compress the gas. The formation sample is pumped into the other end chamber to first, displace the wellbore fluid from the first end chamber and, sequentially, to further compress the gas to preserve the sample phase state upon removal to the surface.

20 Claims, 8 Drawing Sheets

FOREIGN PATENT DOCUMENTS

| | | | |
|---|---|---|---|
| GB | 2022554 | A | 12/1979 |
| GB | 2 322 846 | A | 9/1998 |
| GB | 2322846 | A | 9/1998 |
| GB | 2348222 | A | 9/2000 |
| WO | WO 96/12088 | | 4/1996 |
| WO | WO 01/63093 | A1 | 8/2001 |

* cited by examiner

DUAL PISTON, SINGLE PHASE SAMPLING MECHANISM AND PROCEDURE

CROSS-REFERENCE TO RELATED APPLICATIONS

This application is related to U.S. Provisional Application No. 60/323,220 filed Sep. 19, 2001.

BACKGROUND OF THE INVENTION

1. Field of the Invention

The present invention relates to apparatus and methods for extracting representative samples of earth formation fluids. More particularly, the present invention relates to a tool for obtaining a sample of formation fluid and maintaining the sample in a single phase state until delivered to a testing laboratory.

2. Description of the Related Art

The physical properties of earth formation fluids vary greatly respective to geologically diverse formations. Properties such as chemical composition, viscosity, gaseous phase envelope and solid phase envelope greatly affect the value of a formation reservoir. Further, these properties affect decisions as to whether production may be economically achieved at all and, if so, the duration, expense and unit price of such production. For these reasons, paramount importance is assigned to the accuracy of reservoir fluid samples. Preservation of the in situ phase state of a sample is first among several accuracy criteria.

Various methods exist for extraction of a well sample. Among such methods are those that obtain separate samples of well fluids, liquid and gas, as produced at the well surface. These samples are combined in a manner believed to represent the in situ fluid. Petroleum reservoirs are usually several thousands of feet from the earth's surface and are typically under pressures of several thousands of pounds per square inch. Geothermal temperatures at these depths are on the order of 250° F. or more.

Due to such downhole environmental extremes, transfer of a formation fluid sample to the surface environment carries a possibility of inducing several irreversible changes in the sample. During the rise of a downhole fluid sample to the surface, both pressure and temperature drop dramatically. Such changes may cause certain components of the formation fluid to irreversibly precipitate from solution and/or colloidal suspension and thereby be underestimated by surface sampling. Well production events such as paraffin or asphaltene deposition, may cause substantial downhole damage to the well. Such damage might be entirely avoidable if accurate testing could determine the precise composition, pressure and temperature of the formation fluid. It is especially important for asphaltene studies, where the precipitation and subsequent removal of asphaltene is not well understood, that a formation fluid sample is kept above the saturation pressure to assure that the original composition is maintained.

However, prevention of irreversible changes in a formation sample during retrieval to the surface and discharge into pressurized test or storage devices has remained problematic. Early sample tools employed a fixed volume sample chamber that was initially evacuated. The evacuated sample chamber was lowered to the desired formation depth where a valve was remotely opened to allow an inflow of well fluid into the sample collection chamber. Once filled, the valve was closed for retention of the sample and the chamber retrieved to the surface. During retrieval of the sample tool to the surface, cooling of the sample, in a fixed volume, resulted in a sample pressure decrease. Decreased pressure often resulted in the gasification of certain fractional components of the sample as well as irreversible precipitation of certain solid components. While very careful laboratory studies could be conducted on at least a partially recombined sample and further testing could be performed on components irreversibly separated from the original sample, there persisted a margin of possible inaccuracy which was sometimes critical to very valuable production properties. As those skilled in the art know, some production properties of a formation fluid can be problematic and expensive for cleaning or reworking of the well. It may be difficult, if not impossible, to restore the well to production following a rework.

Efforts to limit or prevent phase changes in formation fluid samples during retrieval and transport to a laboratory or to pressurized storage devices have resulted in variable volume sample chamber tools of two broad groups:

A. Tools having a sample chamber made variable in volume by inclusion of an internal reservoir of compressible fluid therein; and, B. Tools having a sampling chamber made variable in volume by means of a pressurized incompressible fluid. An elastic means such as gas or a spring is typically used to pressure the incompressible fluid, either directly or indirectly through an intermediate piston.

U.S. Pat. No. 3,859,850 issued Jan. 14, 1975 to Whitten, GB20127229 A published in 1979 by Bimond et al, U.S. Pat. No. 4,766,955 issued Aug. 30, 1988 to Petermann and U.S. Pat. No. 5,009,100 issued Apr. 23, 1991 to Gruber et al all disclose subsurface sampling tools that employ a sample chamber of the nature of tools described in group A above. Characteristic of these Group A tools is in the sample chamber. The volume of the sample chamber is, essentially, made elastic by means of a piston that is a moving reservoir wall for a trapped volume of compressed gas. The gas is further compressed internally when pressure outside of the reservoir is greater than internal pressure of the trapped gas reservoir. As the sample tool is lowered downhole, the reservoir of trapped gas, if lower in pressure than the downhole pressure, decreases in volume. Resultantly, a piston in the reservoir is displaced against the trapped gas volume. In theory, upon cooling and contraction of the sample (as by retrieval to the surface), the gas in the reservoir will reexpand and maintain pressure of the sample. However, in order for the volume of the reservoir of the trapped gas to reduce as the reservoir descends and therefore be capable of reexpanding on retrieval, its initial pressure must be somewhat less that bottom-hole pressure of the sample. Additionally, as the sample cools on retrieval, so does the trapped gas thereby further reducing the ability of the trapped gas to reexpand fully from downhole conditions. Thus, while tools of group A may be of some utility, at least for the purpose of limiting the amount of pressure losses in a fluid upon retrieval from downhole, they are inherently incapable of maintaining the sample at or above downhole pressure condition during retrieval. Such tools also fail to disclose leakproof piston seal design. The possibility of gas leakage is mentioned in Bimond et al. In order to detect and account for such leakage, Bimond et al teaches the use of a tracer gas, such as carbon tetra fluoride which is not found in the well sample.

As alternatives to the tools of group A are the tools of group B such as disclosed by GB2022554A by McConnachie, U.S. Pat. No. 5,337,822 issued Aug. 16, 1994 to Massie et al and U.S. Pat. No. 5,662,166 issued Sep. 2, 1997 to Shammai. These tools represent an improvement to the tools of group A in the sense that both have the capability of retrieving a sample while maintaining a sample pressure at or above original downhole pressure. Despite at least the possibility of improved performance, both tools, however, utilize an incompressible fluid to drive, either directly or indirectly, against a trapped volume of sampled fluid. Said piston is powered by an elastic source such as a gas or mechanical spring.

GB2022554A to McConnachie discloses a subsurface flow-through sampling tool. As the sampler descends in the well, well fluid enters and exits the sample chamber through flow-through ports. Once at the desired depth, Well fluid is trapped in the tool by a sliding dual piston means. Valve means then releases a pressurized gas that drives a piston for displacement of mercury under pressure into the sample chamber. The resulting sequence of pressure transmission forces to maintain pressure on the sample is: pressurize gas→piston→mercury→well sample.

U.S. Pat. No. 5,337,822 to Massie et al employs a sample chamber that is divided by a moveable piston. The sample chamber piston is pressurized against the sample by an incompressible fluid such as mineral oil. The mineral oil is, in turn, pressurized by a moveable piston contained in a second chamber. The moveable piston of the second chamber is, in turn, driven by an elastic source such as a gas or mechanical spring in said second chamber. The resulting sequence of pressure transmission forces to maintain pressure on the sample is; elastic source→second piston→incompressible fluid→first piston→oil sample. The Massie tool employs numerous parts and relies on a lengthy sequential operation of multiple valves with the attendant possibility of malfunction.

The sample chamber free piston of U.S. Pat. No. 5,662,166 to Shammai is loaded on the backside by a closed volume of hydraulic fluid. A remotely operated valve opens the closed hydraulic chamber for displacement into a secondary hydraulic chamber thereby permitting the downhole pressure against the front face of the sample chamber piston to displace the piston with a well fluid sample. At a predetermined piston displacement location, gas from a high pressure gas chamber is first released to close the hydraulic conduit between the sample chamber piston backside volume into the secondary hydraulic chamber and sequentially open the high pressure gas source into the piston backside volume to impose a standing compressive load on the sample.

Each of the aforesaid sample tool designs are either limited in performance or inherently complex, costly, likely to require substantial maintenance and are prone to malfunction. Accordingly, it is an object of the present invention to provide an improved tool for taking downhole samples of fluids in an earth borehole. Another object of the invention is to provide a downhole sampling tool capable of maintaining the in situ pressure of a sample at or above the downhole pressure during retrieval of the sample to the surface. Also an object of the invention is a sampling tool that minimizes heat loss from a sample during the well retrieval interval while maintaining high pressure on the sample to offset significant cooling upon retrieval. Another object of the invention is provision of a means for adding a gas accumulator to thermally stabilized sample tanks which are balanced to hydrostatic pressure. Stabilizing the temperature near formation temperature allows a gas accumulator and initial pressure settings to be designed to keep the sample pressure above or equal to formation pressure as the sample cools to the eutectic temperature. An additional object of the present invention is to provide a downhole sampling tool of simple, efficient, reliable and inexpensive design characteristics.

SUMMARY OF THE INVENTION

The present apparatus for receiving and maintaining a downhole sample of formation fluid from an earth bore according to the present invention, preferably is a sample receiving chamber component in a system such as that described by U.S. Pat. No. 5,377,755 to J. M. Michaels et al. The Michaels system comprises a mechanism for engaging a wellbore wall in a manner that will permit the pumped extraction of formation fluid from the formation to the exclusion of wellbore fluid. A pump within the mechanism draws the formation fluid from the wellbore wall and discharges it into a solenoid valve controlled conduit system. In one configuration, the pump discharge conduit is opened by the remotely controlled solenoid valves to the sample receiving chamber of the present invention.

The sample receiving chamber of a preferred embodiment is a variable volume portion of a cylinder that is swept by two free pistons. The free pistons divide the cylinder into three variable volume chambers. The variable volume chamber at one head end of the cylinder may have a remotely controlled fluid conduit connection with the formation fluid pump. The variable volume chamber at the other head end of the cylinder may have an uncontrolled fluid conduit connection with the wellbore fluid. The variable volume chamber between the two pistons is charged with a pressurized gas spring of selected properties.

The gas charged sample receiving chamber is assembled with the remainder of the sampling tool and the tool assembly is secured to a suspension string such as a wireline, tubing or drill string. The tool assembly is lowered into the intended wellbore with the wellbore fluid conduit open to receive standing wellbore fluid and pressure against the end face of the first piston. Bottomhole wellbore pressure against the end face of the first free piston displaces the first piston against the gas charge to a point of pressure equilibrium with the bottomhole pressure. Presumably, the bottomhole pressure is greater than the precharge gas pressure in the intermediate volume resulting in an additional compression of the gas spring.

At the desired formation sampling depth, the tool assembly is remotely directed to engage the formation for a fluid sample extraction. When appropriate, solenoid valves are opened to channel the formation fluid pump discharge into the variable volume of the sample chamber. As formation fluid enters the sample chamber, wellbore fluid is displaced from the opposite head end volume until the first piston displaces substantially all of the wellbore fluid. At this point, the pump will deliver additional formation fluid to further compress the gas charge until the pump displacement pressure capacity is reached. Finally, the pump discharge conduit is remotely closed and the sampling mechanism drawn to the surface.

For another embodiment of the invention, the cylinder encloses an axial rod between the opposite heads to configure the interior spacial volume as a hollow cylinder, e.g. an elongated annular chamber. One head of the chamber may be rigidly integral with the cylinder walls. The opposite head end of the cylinder may be closed by a threaded head-plug, for example. A pair of free pistons translate along the annular chamber to divide the annular space into three variable volumes: a deep head volume between the deep head of the cylinder and the first piston; an intermediate volume between the two pistons; and, a plug head volume between the second piston and the cylinder plug. Both free pistons have pressure sealed, sliding interfaces with the axial rod and the outer cylindrical wall. The second free piston, i.e. the piston adjacent to the cylinder head plug, has, for example, two apertures through the piston extending from face to face. The first aperture includes a check valve on the inner face side of the aperture length to rectify fluid flow into the intermediate cylinder volume only. Proximate of the outer piston face, the first aperture has a threaded plug that permits fluid flow through the aperture in either direction when open and blocks fluid flow in both directions when closed. Setting of the first aperture plug is manual. Only a manually set petcock controls fluid flow through the second aperture Preferably, the plug end of the axial rod is sealed within a plug socket in the plug face by a stab fit into an internal O-ring. A fluid flow conduit extends the length of the axial rod to open at the deep head end into the deep head cylinder volume. The plug head end of the axial rod flow conduit is connected to a first conduit in the cylinder plug having a standing open condition with the wellbore. A second conduit within the cylinder plug opens into the plug head volume and sockets with a solenoid valve controlled conduit from the formation fluid pump discharge.

A further embodiment of the invention is characterized by an outer, tubular vacuum jacket having a cylindrical volume opening at one axial end. The sample receiving cylinder is axially inserted within the vacuum jacket volume. The external surfaces of the sample receiving cylinder are preferably spaced from the inside surfaces of the vacuum jacket thereby providing an air space between the non-contacting adjacent surfaces. The coaxial assembly of the inner tubular body within the vacuum jacket volume is pressure sealed by O-rings and secured by a mutual connecting mechanism such as screw threads or bayonet coupling.

Preferably, while the sample receiving cylinder is removed from the enclosure volume of the vacuum jacket, the cylinder end-plug is also removed. The two pistons are assembled over the axial rod and the assembly inserted along the cylinder volume. Before the cylinder end plug is secured to enclose the plug head volume, a limit sleeve is threaded into the cylinder end as a structural displacement limit on the second piston With the limit sleeve in place, a source of high pressure gas, preferably an inert gas such as nitrogen at about 2000 to 2500 psi, for example, is connected to the first aperture of the second piston to charge the intermediate volume. With the charge complete, the check valve in the first aperture holds the charge in the intermediate volume while the gas source is disconnected. When the disconnection is complete, the first aperture petcock is manually closed to assure no leakage loss past the check valve.

In this state of preparation, the cylinder head plug is placed over the plug end of the axial rod and secured to the cylinder wall adjacent to the piston limit sleeve. Next, the sampling cylinder is coaxially inserted within the vacuum jacket and the assembly is combined with the other components of the sampling tool mechanism. Installation of the cylinder connects the second end plug conduit with the formation fluid discharge conduit whereby formation fluid discharged by the pump is delivered into the plug head volume.

An additional operative in the present invention is the cooling effect on the formation sample as it enters the plug head volume which has been insulated from the bottomhole heat by the surrounding air and vacuum jacket. As a consequence of the cooling, the formation sample has an increased density at the elevated pump pressure thereby increasing the weight of sample obtained in a given volume.

Although the formation fluid sample within the second end chamber loses heat as the tool is drawn to the surface, the rate of that heat loss is attenuated by the insulation of the surrounding vacuum jacket.

At the surface, the wellhead fluid conduit is immediately connected to a high pressure water source, for example, and the cylinder pressure further increased. This additional pressure on the formation sample offsets the density loss due to the ultimate cooling of the sample to the surface ambient thereby preserving the single phase integrity of the sample constituency.

Following the final water pressure charge, the inner tubular body may be withdrawn from the outer tube vacuum jacket to reduce the weight and bulk for shipment to a remote analysis laboratory.

BRIEF DESCRIPTION OF THE DRAWINGS

The following detailed description of the invention is supported by the drawings wherein like reference characters designate like or similar elements of the invention assembly throughout the several figures of the drawings and.

DETAILED DESCRIPTION OF THE PREFERRED EMBODIMENTS

Component And Assembly Description

With respect to all figures of the drawings, the invention comprises the axial assembly of several units that are normally configured with a circular cross-sectional geometry. Except for deployment convenience, however, the external configuration of the invention may be a matter of individual choice.

Figure 1:
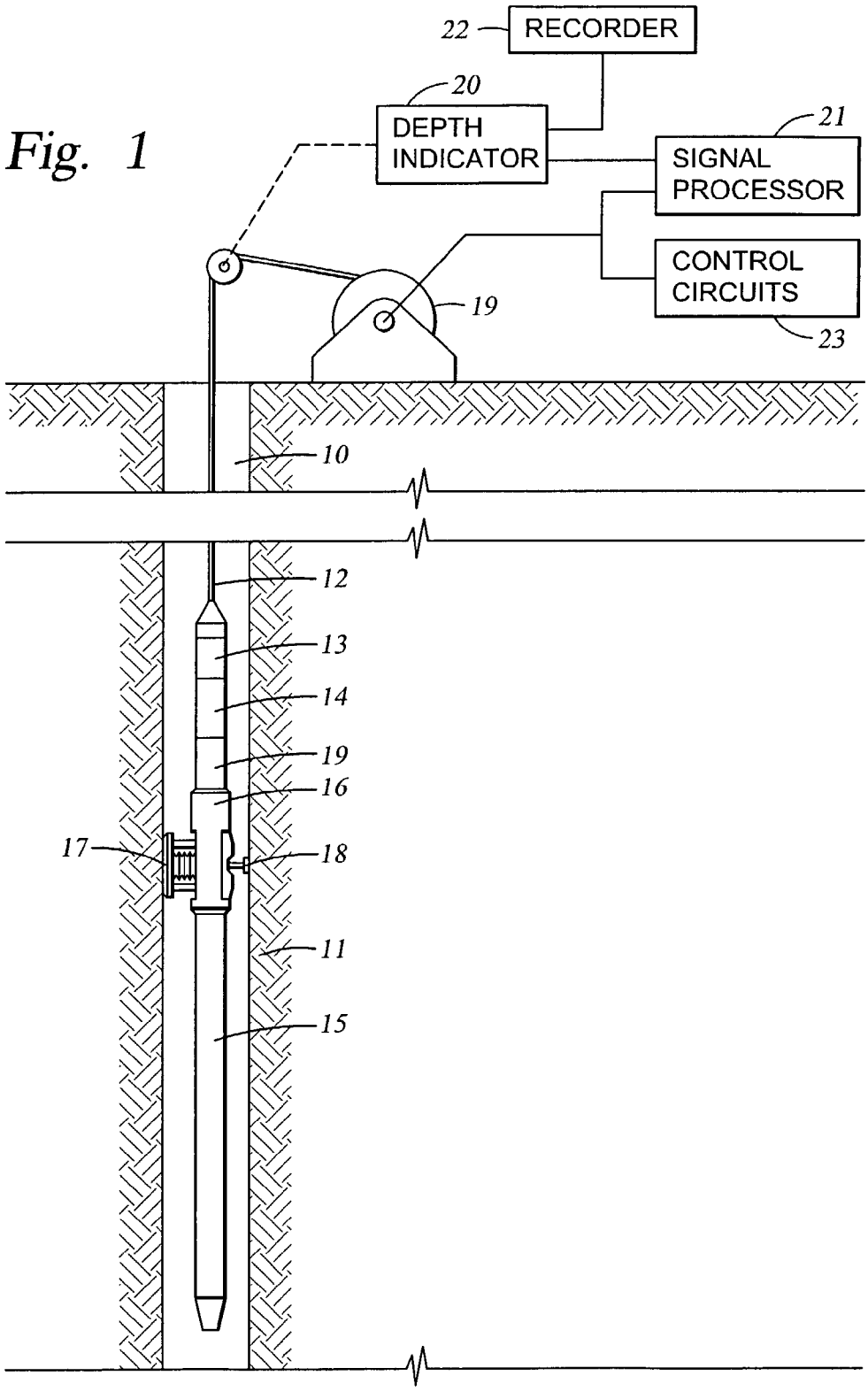
FIG. 1 is a schematic illustration of the invention in operative assembly with cooperative devices for extracting a sample of formation fluid from within a deep wellbore.

With respect to FIG. 1, a section of borehole 10 is schematically illustrated as penetrating earth formations 11. Disposed within the borehole 10 by means of a cable or wireline 12 is a sampling and measuring instrument 13. The sampling mechanism and measuring instrument is comprised of a hydraulic power system 14, a fluid sample storage section 15 and a sampling mechanism section 16. Sampling mechanism section 16 includes a selectively extensible well wall engaging pad member 17, a selectively extensible fluid admitting sampling probe member 18 and bidirectional pumping member 19. The pumping member 19 could also be located below the sampling probe member 18 if desired.

In operation, sampling and measuring instrument 13 is positioned within borehole 10 by winding or unwinding cable 12 from hoist 20, around which cable 12 is spooled. Depth information from depth indicator 21 is coupled to signal processor 22 and recorder 23 when instrument 13 is disposed adjacent an earth formation of interest. Electrical control signals from control circuits 24 are transmitted through electrical conductors contained within cable 12 to instrument 13.

These electrical control signals activate an operational hydraulic pump within the hydraulic power system 14 such as that described by U.S. Pat. No. 5,377,755 to John M. Michaels et al and incorporated herein by reference. The power system 14 provides hydraulic power for instrument operation and for causing the well engaging pad member 17 and fluid admitting member 18 to move laterally from instrument 13 into engagement with the earth formation 11. The power system 14 also drives the double acting pumping member 19. Fluid admitting member or sampling probe 18 can then be placed in fluid communication with the earth formation 11 by means of electrically controlled signals from control circuits 24. Within the instrument 13 are solenoid valves that control fluid flow from the pump 19 into a sample accumulation chamber within the sample storage section 15. These instrument 13 solenoid valves are normally controlled from the surface.

Figure 2:
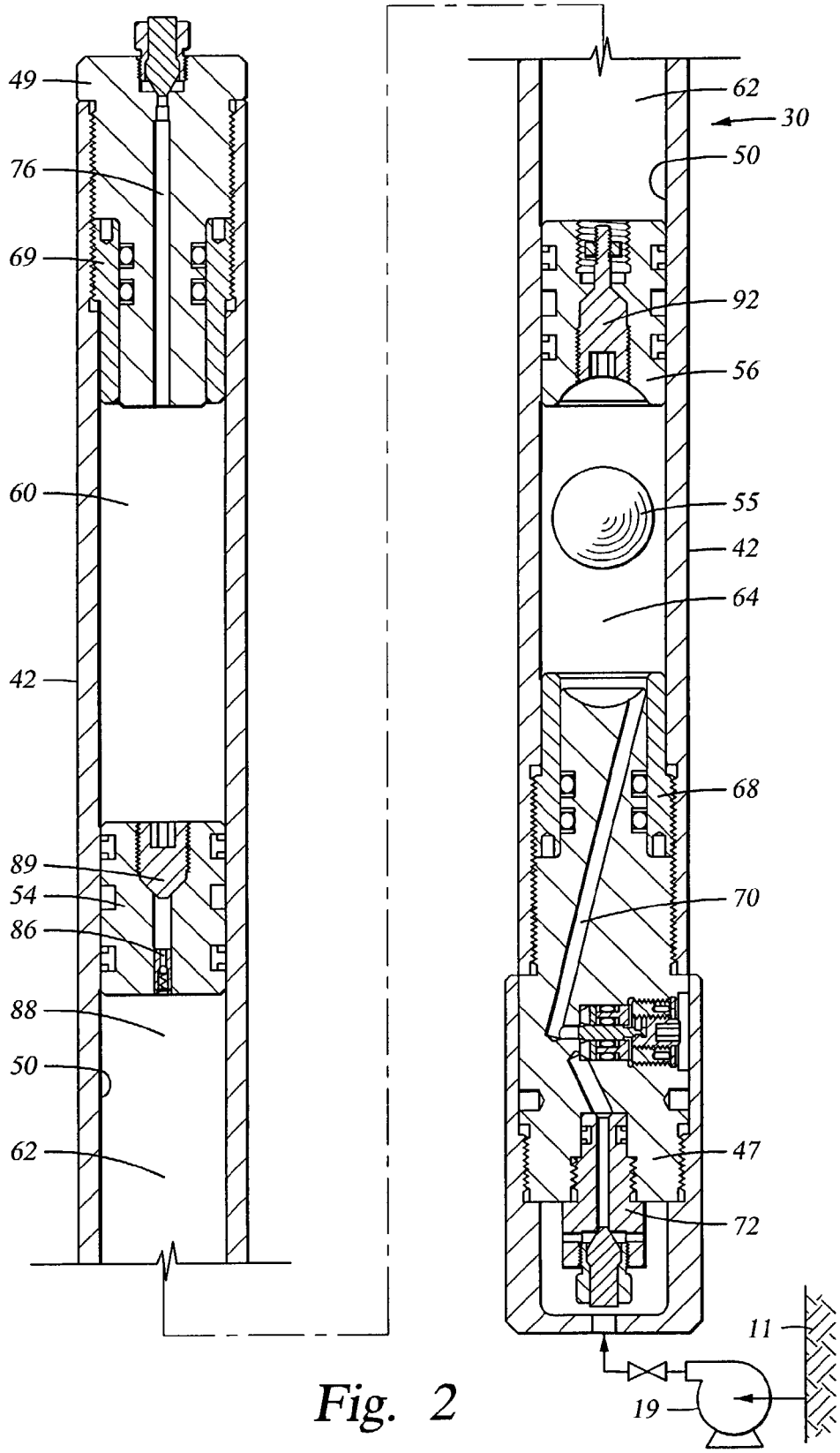
FIG. 2 is a schematic sectional view of a fundamental invention embodiment.

Within the sample storage section 15 are one or more sample accumulation chambers 30. FIG. 2 schematically illustrates a fundamental configuration of an accumulation chamber 30 according to the present invention. Such fundamental configuration or embodiment comprises a cylinder wall 42 that encloses a cylindrical volume 50 between opposite cylinder end plugs 47 and 49.

Within the cylindrical volume 50 are two free pistons 54 and 56. The free pistons 54 and 56 divide the cylindrical volume 50 into three variable volume chambers 60, 62 and 64.

The formation sample chamber 64 may, for example, communicate with a valve controlled formation fluid transfer conduit 70 from the formation pump 19 that is connected through the cylinder end plug 47. An agitation ball 55 is placed in sample chamber 64 upon final assembly. The wellbore chamber 60 may receive a conduit 76 having an uncontrolled reversible flow communication with the wellbore annulus. The intermediate chamber 62 between the pistons 54 and 56 may be charged with a suitable gas through conduit 86 in the piston 54. The conduit 86 includes a check valve 88 in series with a valve or plug 89 set within a piston boss 58.

The cylinder end plugs 47 and 49 make a sealed interface with respective retainer sleeves 68 and 69. The end plug 49 is removed from the cylinder end for connection access to the piston conduit 86. When the intermediate volume 62 is charged with gas, the gas pressure drives the pistons 54 and 56 against the opposite limit sleeves 68 and 69. When the gas charge is complete, the charging conduit is removed from the piston conduit 86. The check valve 88 prevents an exhaust flow of gas from the volume 62 until the conduit 86 is secured by the valve 89.

The cylinder sample chamber 64 is finally closed by assembling the end plug 49. The end plug is penetrated by the wellbore fluid conduit 76.

Those of ordinary skill will understand that the conduit 86 in piston 54 is merely one of many devices and methods to charge the intermediate volume 62 with a selected gas to a predetermined pressure. Preferably, some means will also be provided to safely and controlably release the gas charge such as a needle valve 92.

Figure 3:
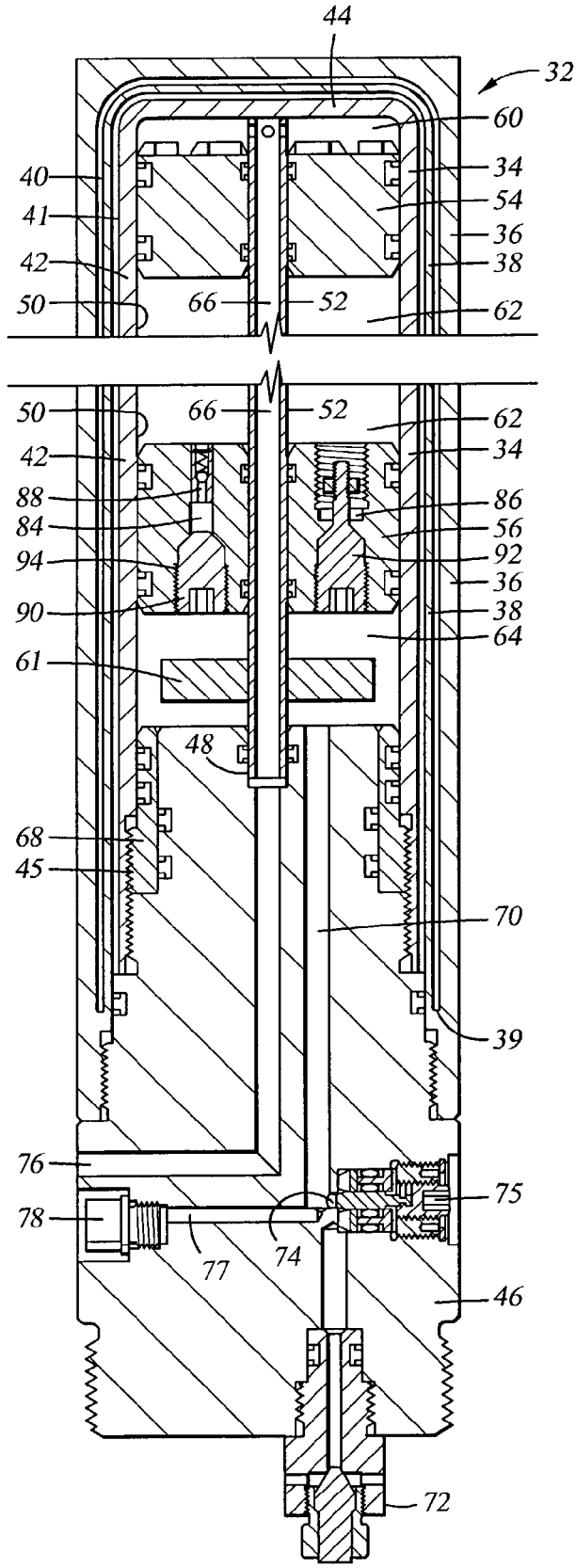
FIG. 3 is a schematic sectional view of one axial end of a second embodiment of the invention.

An alternative embodiment of the invention is illustrated by FIG. 3 wherein each accumulation chamber 30 includes an outer vacuum jacket 32 and an interior reservoir tube 34. Preferably, the reservoir tube 34 has a secured coaxial fit within the vacuum jacket space to provide an intermediate air space 41. The vacuum jacket 32 comprises an outer cylindrical shell 36 that envelopes an inner shell 38. An atmospherically evacuated space 40 separates the inner and outer shells 38 and 36 except at the mutual neck region 39.

The reservoir tube 34 comprises a cylinder wall 42 that encloses an internal cylindrical volume 50. The enclosed volume 50 is further defined by a substantially solid head wall 44 at one axial end and a threaded end cap 46 at the opposite axial end. The interface between the end cap 46 and the inside face of the cylinder wall 42 is pressure sealed with one or more O-rings.

Extending coaxially within the cylindrical volume 50 between the head wall 44 and the end cap 46 is a guide rod 52. The guide rod 52 has a fluid flow conduit 66 extending the length of the rod and opening at the head wall end into the variable volume chamber 60. Disposed for free translation along the guide rod length are a pair of pistons 54 and 56. The pistons divide the internal cylinder volume 50 of the reservoir tube 34 into three, variable volume spaces 60, 62 and 64.

The end-cap 46 includes an O-ring sealed guide rod socket 48 that receives the end of the guide rod 52 by an axial stab fit. The guide rod socket 48 is served by a wellbore fluid conduit 76 in the end cap 46 that communicates with the guide rod conduit 66. If desired, conduits 66 and 76 may be open to uncontrolled flow communication with the wellbore fluid. The end cap also includes a formation fluid delivery conduit 70 having a fluid flow connection between a storage section 15 interface socket 72 and the end cap end of the internal cylinder volume 50. The interface socket 72 connects the end cap conduit 70 to the discharge conduit of the formation fluid pump 19. The conduit 70 is intersected by a spur conduit 74 that is opened and closed by a manual valve 75.

A second spur conduit 77 from the formation sample conduit 70 is plugged by a data transducer 78. The data transducer may measure temperature, pressure or both for either downhole recordation or direct transmission to the surface. A practical utility of the data transducer 78 is to obtain a direct measure of temperature and pressure of a formation sample in chamber 64 after retrieval to the surface but without physically disturbing the sample such as by opening a valve. Such data provides immediate information on the sample integrity in the event that the pressure, for example, has fallen below the bubble point due to a mechanical or seal failure.

With respect to FIG. 3, a piston limit sleeve 68 is threaded into the plug end of the cylinder 42 as a separate but cooperative element of the end plug 46. The interior perimeter of the end plug 46 is counterbored to fill the volume within the sleeve 68 with an O-ring sealed fit.

Continuing the reference to FIG. 3, the piston 56 most proximate of the end plug 46 includes two face-to-face conduits, 84 and 86. Flow through the conduit 84 is rectified by a check valve 88. The conduit 84 may also be completely closed by a needle valve 90. Tubing connection threads 94 in the conduit 84 on the chamber 64 face of the piston 56 provide a connection point for a source of high pressure gas such as nitrogen. The second conduit 86 between opposite faces of the piston 56 is flow controlled by a needle valve 92. Both of the needle valve elements 90 and 92 are manually operated by Allen sockets.

Valve 92 is opened for assembly of the piston 56 into the cylinder 42 to transfer atmosphere trapped behind the piston as it advances into the cylinder volume 50. Atmosphere behind piston 54 is vented through the rod conduit 66 as the piston is pushed to the head wall end of the cylinder 42. When the piston 56 is suitably deep within the cylinder volume 50, the valve 92 is manually closed.

It is to be understood that the end cap 46 and limit sleeve 68 are disassembled from the cylinder wall 42 for insert accessibility of the pistons 54 and 56 into the cylinder volume 50. With both pistons in place, the limit sleeve 68 is turned into place on the cap threads 45 and a source of pressurized gas is connected to the piston 56 conduit 84 by means of the connection threads 94.

There will be some degree of anticipation for the bottomhole (formation sample extraction depth) temperature and pressure as a basis for the type of gas to be charged into the intermediate chamber 62. The gas pressure in the intermediate volume 62 will normally rise above that value charged at the surface due to a rise in the wellbore temperature. This pressure increase is a function of the gas physical properties, the absolute mass of gas in the volume 62 and the initial charging pressure and temperature. Preferably, however, the resulting pressure value should be less than the bottomhole hydrostatic pressure.

In one embodiment of the invention, the preferable gas is an inert or semi-inert material such as nitrogen. Gas pressures in the order of 2000 to 2500 psi are normally considered high pressures. However, certain constructions and applications of the invention may require more or less pressure.

In another embodiment, personal safety concerns and well site equipment limitations may dictate the use of an air charge in volume 62 to about 100 psi to about 200 psi.

Upon receiving the gas pressure within the intermediate cylinder volume 62, both pistons 54 and 56 will be displaced to opposite extremes of the greater volume 50. Piston 56 will abut the limit sleeve 68. Before the end cap 46 is turned into place, a sufficient volume of hydraulic oil is charged into the conduit between the check valve 88 and the needle valve 90 to protect the check valve 88 seat. Closure of the conduit 84 is now secured by the manual valve 90. The sample chamber agitator 61 is inserted and the end cap 46 is assembled to complete the assembly and preparation of the reservoir tube 34. The tube may now be assembled with the vacuum jacket and positioned in the sample storage section 15 of the sampling assembly.

Invention Operation

The need for a gas filled intermediate chamber 62 is apparent upon examining the relationship between pressure and temperature for a confined sample.

The contraction or shrinkage of a liquid when cooling is described by the equation:

$$\Delta V=\gamma\times\Delta T\times V \qquad \text{Eq. 1}$$

Where:

$\Delta V$ is the volume change of a liquid in $cm^3$.

$\gamma$ is the coefficient of cubical thermal expansion, volume/volume/°F.

$\Delta T$ is the temperature change in degrees F.

V is the volume of liquid that is cooling, $cm^3$.

Values for $\gamma$ range from about 0.00021 to about 0.0007/°F. with 0.00046/°F. as a reasonable value for oil.

The compressibility of a liquid is described as:

$$C_f=\Delta V\div V\times\Delta P \qquad \text{Eq. 2}$$

Where:

$C_f$ is the liquid compressibility in volume/volume/psi.

$\Delta V$ is the volume change in $cm^3$

V is the volume of liquid being compressed in $cm^3$.

$\Delta P$ is the pressure change in psi.

Figure 8:
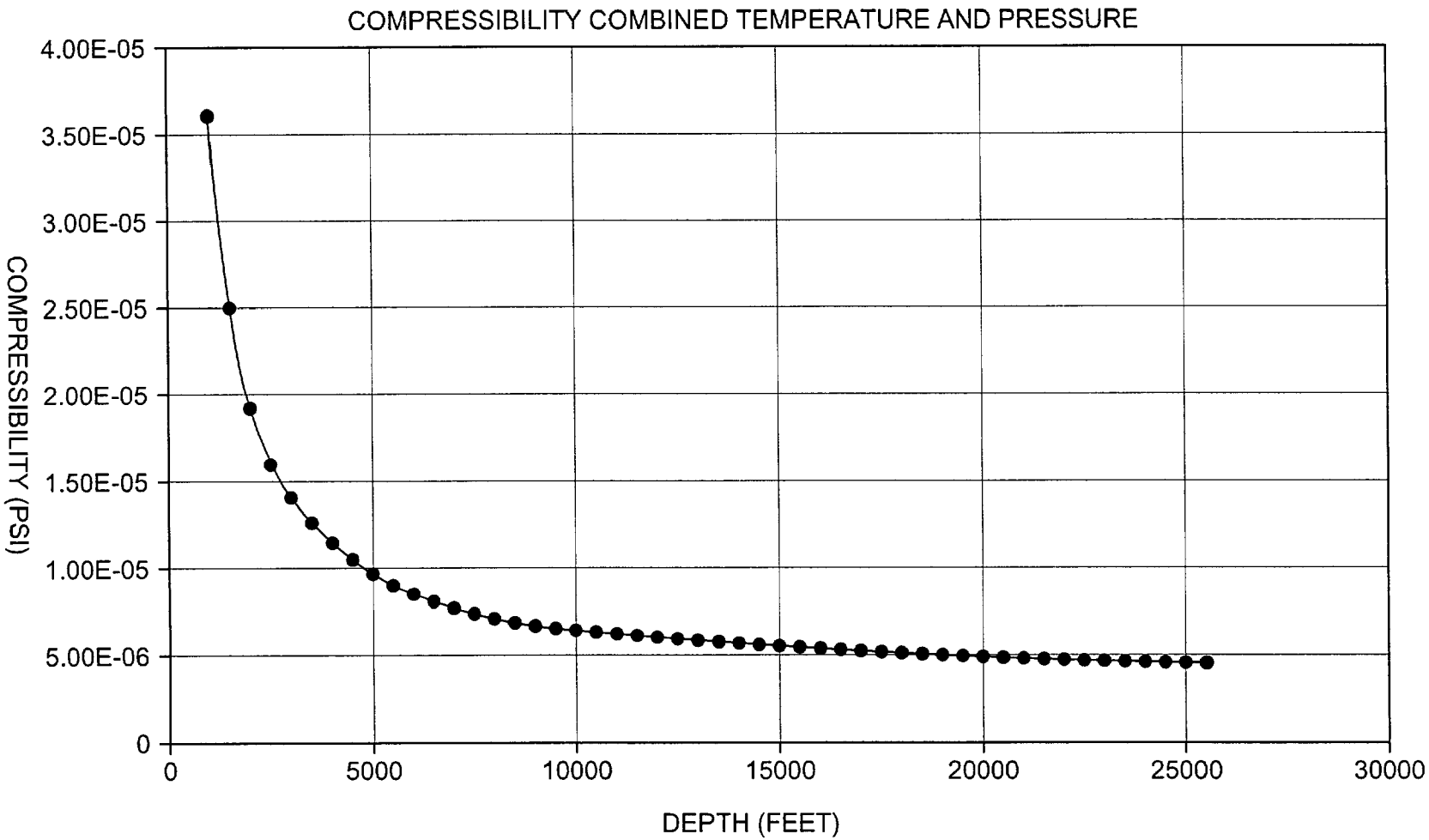
FIG. 8 is a graph that charts the relationship of formation fluid compressibility properties to wellbore depth according to Vasquez and Beggs.

The Vasquez and Beggs graph of FIG. 8 illustrates compressibility as a function of wellbore depth. Because compressibility is sensitive to pressure and temperature, pressure is related to depth through a pressure gradient of 0.52. psi/ft. And temperature is included through a temperature gradient of 0.01° F./ft.

As published in the 1972 Ed. of *Petroleum Engineering Handbook,* page 22-12, the Vasquez and Beggs relationship is:

$$C_f=[(5\times R_{sb})+(17.2\times T)-(1180\times G_g)+(1261\times G_o)-1433]\div[P\times 10^5] \qquad \text{Eq. 3}$$

Where:

$C_f$=compressibility in volume/volume/psi $R_{sb}$=solution gas:oil ratio in standard cubic feet/stock tank barrel.

T=Temperature, °F.

$G_g$=gas gravity relative to air=1.

$G_o$=stock tank oil gravity in °API.

P=pressure in psi.

Substituting the volume change during cooling from the equation for cubical thermal expansion into the expression for compressibility yields $$\Delta P=[\gamma\times\Delta T]\div C_f \qquad \text{Eq. 4}$$

Substituting the typical values for $\gamma$ and $C_f$ previously mentioned, the pressure drop is $$\Delta P=76.67\times\Delta T \qquad \text{Eq. 5}$$

An oil sample with a GAS:OIL ratio of 500 scf/STB that is pressurized to 4500 psi above saturation pressure at 200° F. will return to saturation pressure when the temperature cools to approximately 138° F. This calculation includes the decrease in saturation pressure which occurs with temperature.

Limiting the temperature drop significantly reduces the accumulator capacity needed to maintain a sample above saturation pressure.

The method disclosed maintains a sample near reservoir pressure by adding a second floating piston to act as a gas accumulator for tanks balanced to hydrostatic pressure.

As the tool descends into a wellbore, standing fluid within the wellbore enters the head wall chamber 60 via the end plug conduit 76 and rod conduit 66 as represented by FIG. 3. When the tool reaches bottom hole, the pressure within the chamber 60 corresponds to the bottomhole wellbore pressure. Presumably, this hydrostatic bottomhole pressure is greater than the static pressure of the gas charged into the intermediate gas chamber 62 resulting from a bottomhole temperature increase. Under the wellbore pressure drive, piston 54 is displaced into the intermediate volume 62 thereby compressing the gas therein to a pressure equilibrium with the bottomhole wellbore pressure.

Figure 4:
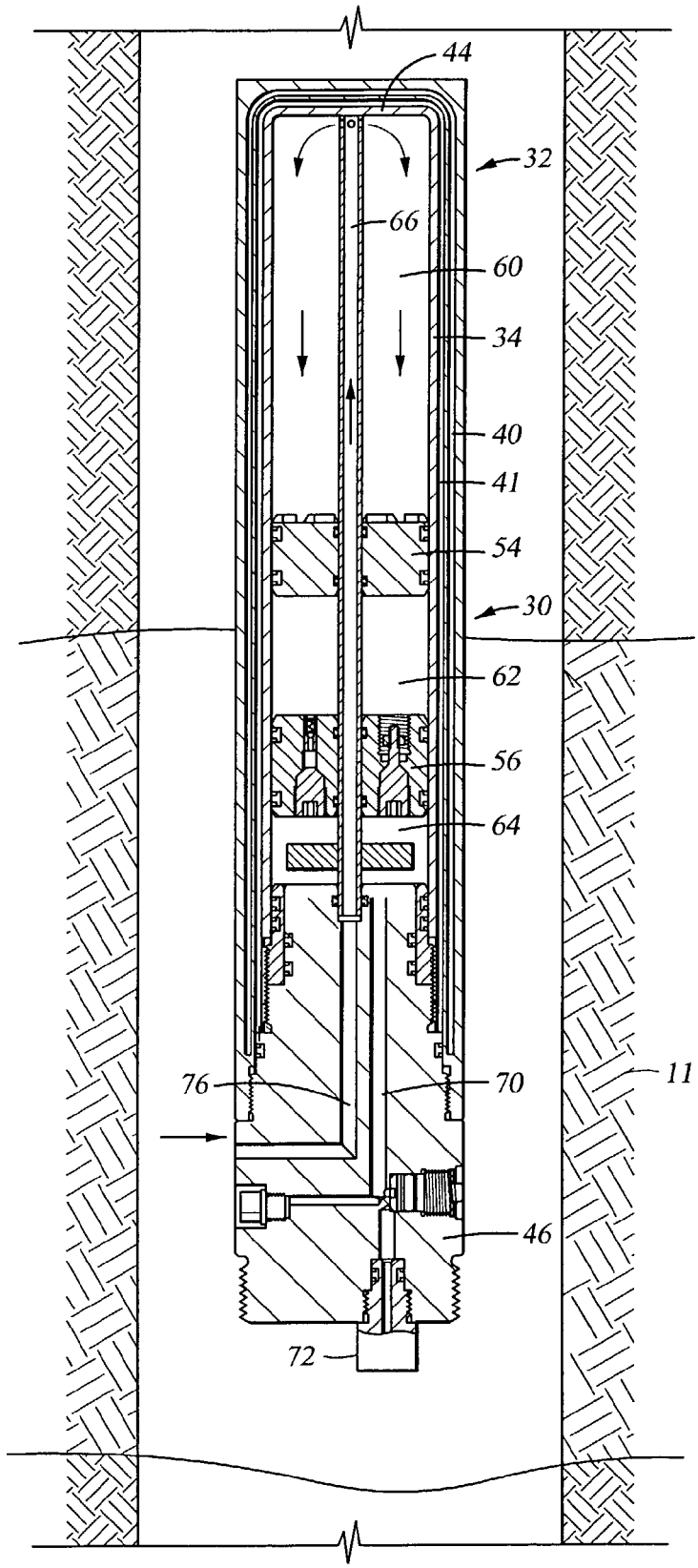
FIG. 4 is a schematic representation of the invention sample tank in the process of descending downhole.

At this point, the formation sample extraction devices are engaged to produce a pumped flow of formation fluid into the sample conduit 70 as is represented by FIG. 4. This flow is delivered by the conduit 70 into sample chamber 64. Significantly, the void volume of sample chamber 64 is minimal to none. Existence of chamber 64 void volume invites an opportunity for phase dissociation of the first flow elements from the formation, a result that is to be desirably minimized. Due to the wellbore pressure compression of the gas chamber, a corresponding pressure is required in the sample chamber 64 to displace the piston 56. Initially, the accumulation of formation fluid within the sample chamber 64 is reflected by a corresponding displacement of wellbore fluid from the chamber 60 through the open conduits 66 and 76. When all of the wellbore fluid has been displaced from chamber 60 and the piston 54 has bottomed against the head wall 44, additional formation fluid pumped into chamber 64 contributes to a further compression of gas in the intermediate chamber 62. This further compression continues until the pump 19 reaches its displacement pressure capacity. At this point, an external solenoid valve in the pump discharge conduit is remotely closed and the apparatus withdrawn from the well.

Construction design notice should be taken of the possibility that although the piston 56 is pressed by the gas pressure in chamber 62 against the end cap 46, some volumetric voids may remain between the pump 19 and the pressure face of piston 56. These volumetric voids may not be charged with wellbore pressure and may therefore be the source of some "phase flashing" of the first formation fluid elements arriving from the pump 19. For this reason, care is to be taken in filling the end plug volume encompassed by the limit sleeve 68.

As the apparatus rises within the wellbore, the surrounding temperature falls accordingly to cool the assembly. Although the formation fluid sample loses heat the rate of such heat loss is dramatically attenuated by the vacuum space 40 and air space 41. The relatively small cooling of the of the formation fluid sample is substantially offset by the bottomhole cooling the sample received when it entered the sample chamber 64. The sample accumulation chamber 30 was at surface ambient temperature when it started down the borehole. Heating of the reservoir tube 34 is inhibited by the vacuum jacket 32. Hence, when the formation fluid first enters the sample chamber 64, it expresses heat energy to the surrounding structure but without losing static pressure. Hence, the formation fluid increases density within the chamber 64 and captures a greater weight of formation fluid in the volume 64 than could be captured at a higher temperature.

Upon cooling of the formation fluid sample, which substantially is an in situ liquid or plasticized solid, pressure loss on the liquid is highly proportional to temperature loss and volumetric shrinking. Although the same thermodynamic forces are acting upon the gas charge in chamber 62, there is no corresponding proportionality in the interrelationship of pressure, volume and temperature. Loss of density and pressure in the gas chamber 62 due to cooling is substantially less than that of the liquid in sample chamber 64 without the gas pressure bias. Pressure on the formation fluid sample remains the same as the compressible gas pressure in the chamber 62 and above the critical disassociation pressure.

Figure 5:
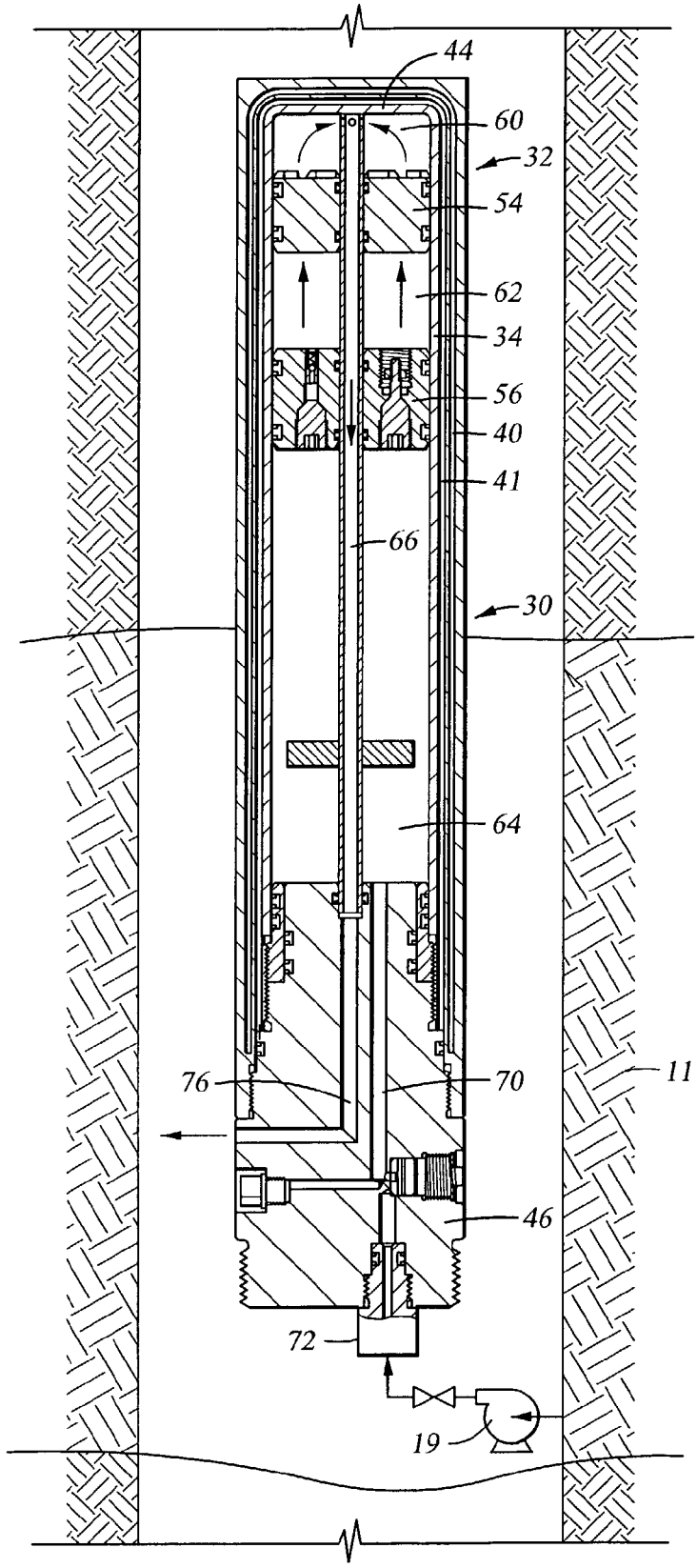
FIG. 5 is a schematic representation of the invention sample tank receiving a formation fluid sample from the formation pump.
Figure 6:
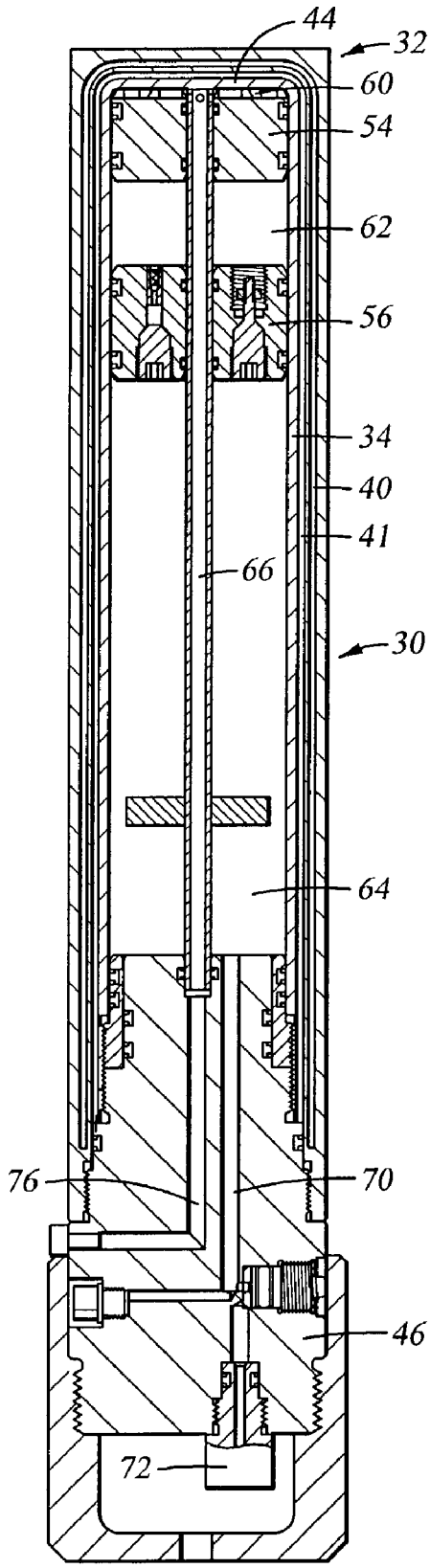
FIG. 6 is a schematic sectional view of the inner tubular body of the sample tank separated from the vacuum jacket.

Upon reaching the surface, the static pressure remaining on the formation sample may be further increased by connection of the plug conduit 76 with a high pressure water source not shown. Such high pressure water is to be applied to the chamber 60 thereby driving the piston 54 against the gas chamber 62 as represented by FIG. 5. Although the temperature of all fluid in the reservoir tube 34 will eventually decline to the surface ambient, the vacuum jacket 32 slows the cooling rate sufficiently to permit the single phase maintenance pressure to be increased to a comfortable level by water pressure in the chamber 60.

Figure 7:
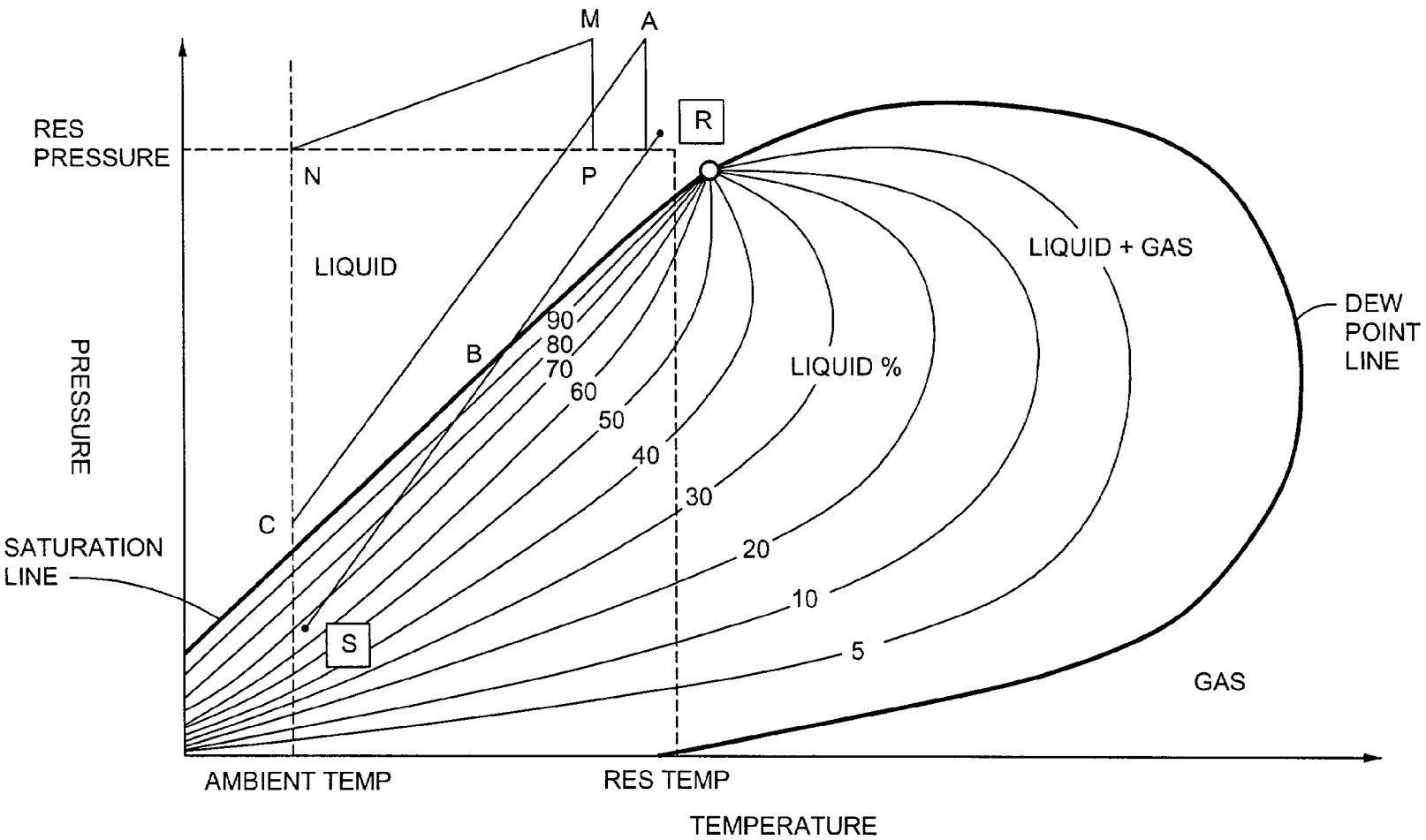
FIG. 7 is a phase diagram for a typical hydrocarbon.

The thermodynamic principles of the invention are further represented by the diagram of FIG. 7 which illustrates the phase diagram of a typical hydrocarbon. Point "R" indicates the reservoir condition. In this phase diagram, there are three sampling processes shown by lines "RBS", "RAC" and "RPMN". The line "RBS" illustrates a sampling process without any pressure compensation. The sample pressure and temperature plot, in this case, would cross into the two-phase region at the point "B" resulting in a two-phase sample at the ambient condition.

A prior art sampling process is shown by the line "RAC". Line "RA" indicates the over pressuring of the sample above the reservoir pressure. However, depending on the kind of sample collected, this process may or may not result in a single-phase sample. Therefore, point "C" could be in the two-phase region.

The present invention is represented by the line "RPMN". The sample is cooled while entering the reservoir tube 34 at reservoir pressure. Line "RP". Such cooling reduces the overall sample shrinkage due to temperature reduction during the retrieval. Further, the sample is presurized above the hydrostatic wellbore pressure by the extraction pump 19. Line "PM". The sample pressure is maintained during the retrieval by the high pressure nitrogen trapped in the intermediate chamber 62. Line "MN".

An alternative embodiment of the invention might substitute a eutectic compound or material for the vacuum space 40 in the vacuum jacket 32. A eutectic salt, for example, may be selected to absorb the geothermal wellbore heat for a solid-to-liquid phase change below but near the bottomhole temperature. As the extracted formation sample, captured in the reservoir tube 34, is returned to the surface, the eutectic jacket surrounding the reservoir tube yields its disproportionate phase transition heat to the reservoir tube and sample thereby reducing the sample heat loss rate. Suitable eutectic materials may also include relatively low melting point metals such as described by U.S. Pat. No. 5,549,162, the description of which is incorporated herewith by reference.

An additional embodiment of the invention may exploit the stored energy of a compressed metal or elastomeric spring bearing upon a single floating piston. The spring would be compressed at the surface so that pumping a formation fluid sample into the sample chamber 64 would require hydrostatic pressure plus the pressure due to the spring compression preload to displace the single piston. The pressure in the sample chamber would still be limited to the pump pressure plus the hydrostatic pressure. Upon cooling, the sample pressure would, for example, decrease at 76.67 psi/F until the pressure equals the pressure at which the spring is fully compressed. Further cooling will allow the spring to extend. As the spring extends to compensate for cooling, sample pressure will decrease in proportion to the spring rate.

The sample will contract about 3% of the sample volume when cooled from 200° F. to 137° F. Since the volume is linear with piston movement, the sample pressure will stabilize at 97% of the pressure reached when the spring was fully compressed.

The foregoing descriptions of our invention include references to a pump 19 for extracting formation fluid and delivering it into the sample chamber 64 by displacing wellbore fluid from an opposite end chamber or against the bias of a mechanical spring. It will be understood that the fundamental physics engaged by the pump 19 is an increase in the formation fluid total pressure to overcome the total pressure on the piston 56 thereby displacing the piston 56 against the gas in intermediate chamber 62 or against a mechanical spring. There are other techniques for accomplishing the same end without using that means or apparatus normally characterized as a "pump". Hence, the term "pump" as used herein and in various claims to follow, is meant to encompass and device, means or process that imparts energy to in situ formation fluid in such a manner as to extract it from the formation and inject it into the sample chamber 64 of this invention.

The presently preferred embodiments of our invention have been described to inform others of ordinary skill in the art to make and use the invention. However, numerous changes in the details of construction, and the steps of the method will be readily apparent to those same skilled in the art and which are encompassed within the spirit of the invention and the scope of the appended claims.

What is claimed is:

1. A vessel for maintaining the phase integrity of a fluid comprising:

a fluid receiving chamber having at least one moveable partition;

a force bias on the moveable partition that partially includes a preload on the moveable partition;

a pump for extracting formation fluid and transferring the fluid into the receiving chamber against the bias of the force, wherein the force bias applies the preload directly to the fluid via the at least one moveable partition; and a data transducer in communication with the fluid receiving chamber for measuring data associated with the fluid in the receiving chamber.

2. A vessel as described by claim 1 wherein the preload comprises a mechanical spring.

3. A vessel as described by claim 1 wherein the data is pressure.

4. A vessel as described by claim 1 wherein the preload is an elastomer spring.

5. A vessel as described by claim 1 wherein the data is temperature.

6. A vessel as described by claim 5 wherein wellbore hydrostatic pressure is imposed on a second moveable partition.

7. A vessel as described by claim 6 wherein the preload is disposed between the at least one moveable partition and the second moveable partition.

8. A vessel for maintaining the phase integrity of a fluid, comprising:

a fluid receiving chamber having a preload against a moveable chamber partition while receiving the fluid; and a heat transfer barrier substantially enclosing the fluid receiving chamber.

9. A vessel as described by claim 8 wherein the heat transfer barrier comprises a vacuum space.

10. A vessel as described by claim 9 wherein the heat transfer barrier comprises an air space.

11. A vessel as described by claim 8 wherein the heat transfer barrier comprises a detachable jacket substantially surrounding the fluid receiving chamber.

12. A vessel as described by claim 8 wherein the heat transfer barrier comprises a fusible metal.

13. A vessel as described by claim 8 wherein the heat transfer barrier comprises a eutectic compound.

14. A method for collecting a sample of formation fluid comprising:

preloading a moveable member in a vessel; and transferring the formation fluid into the vessel by displacing the moveable member against the preload, wherein the fluid is cooled and transferred into the vessel.

15. A method as described by claim 14 wherein the preload is calibrated to maintain a pressure of the fluid above a bubble point of the fluid.

16. A method as described by claim 14 wherein the preload upon the movable member comprises a pressurized gas.

17. A method as described by claim 16 wherein the pressurized gas is a substantially inert gas.

18. A method as described by claim 16 wherein the pressurized gas is substantially nitrogen.

19. A method as described by claim 16 wherein the pressurized gas is substantially air.

20. A method for collecting a sample of formation fluid comprising:

preloading a moveable partition in a sample collection chamber with a force;

extracting the formation fluid from a formation;

transferring the formation fluid into the sample collection chamber by displacing the moveable partition against the force;

applying the preload directly to the formation fluid via the at least one moveable partition; and measuring data associated with the formation fluid in the sample collection chamber.

* * * * *

UNITED STATES PATENT AND TRADEMARK OFFICE

CERTIFICATE OF CORRECTION

PATENT NO. : 7,246,664 B2
APPLICATION NO. : 10/242112
DATED : July 24, 2007
INVENTOR(S) : Houmann Shammai et al.

It is certified that error appears in the above-identified patent and that said Letters Patent is hereby corrected as shown below:

On The Title Page (75):
Inventors: "Phillip Wills" should read -- Philip Wills --

Signed and Sealed this

Eighteenth Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,246,664 B2
APPLICATION NO. : 10/242112
DATED : July 24, 2007
INVENTOR(S) : Houmann Shammai et al.

It is certified that error appears in the above-identified patent and that said Letters Patent is hereby corrected as shown below:

On The Title Page (75):
Inventors: "Phillip Wills" should read -- Philip Wills --

Signed and Sealed this

Twelfth Day of February, 2008

JON W. DUDAS
*Director of the United States Patent and Trademark Office*

UNITED STATES PATENT AND TRADEMARK OFFICE

CERTIFICATE OF CORRECTION

PATENT NO. : 7,246,664 B2
APPLICATION NO. : 10/242112
DATED : July 24, 2007
INVENTOR(S) : Houmann Shammai et al.

It is certified that error appears in the above-identified patent and that said Letters Patent is hereby corrected as shown below:

On the title page, item [75]:

Inventors: "James Cernooek" should read -- James Cernosek --

Signed and Sealed this

Thirtieth Day of September, 2008

JON W. DUDAS
*Director of the United States Patent and Trademark Office*